US005199330A

United States Patent [19]

Arnold et al.

[11] Patent Number: 5,199,330

[45] Date of Patent: Apr. 6, 1993

[54] REVERSING RATCHET WRENCH

[75] Inventors: Robert L. Arnold, Leola; Richard P. Folkenroth, Windsor; James A. VanLenten, Lancaster; Kenneth J. Taggart, Columbia, all of Pa.; James P. Gurzenski, Long Meadow, Mass.

[73] Assignee: Easco Hand Tools, Inc., Lancaster, Pa.

[21] Appl. No.: 769,866

[22] Filed: Oct. 1, 1991

[51] Int. Cl.[5] ..... B25B 13/46

[52] U.S. Cl. ..... 81/63.2; 24/563; 81/63

[58] Field of Search ..... 81/60, 63–63.2; 24/543, 563; 411/352, 353, 517–519, 522–524

[56] References Cited

U.S. PATENT DOCUMENTS 2,519,987 8/1950 Wernette ..... 24/563 X
3,176,691 4/1965 Ericson ..... 24/563 X
4,142,704 3/1979 Murray ..... 411/353 X
4,903,554 2/1990 Colvin ..... 81/63.2 X
4,934,220 6/1990 Slusar et al. ..... 81/63.2

*Primary Examiner*—James G. Smith
*Attorney, Agent, or Firm*—Leonard Bloom

[57] ABSTRACT

A reversing ratchet wrench especially suited for mass production and having few easily machinable parts. The pawl and driver are provided with overlapping covers which retain the pawl and protect the engaging teeth. The driver cover is flush with the wrench head for added convenience, yet makes no contact because the driver is supported on a driver skirt. Hence, the wrench is highly impact resistant. A unique retaining clip for retaining the driver allows convenient replacement of the pawl cap/reversing lever without removal of the pawl. Likewise, the wrench can be completely disassembled without special tools, thereby facilitating point-of-sale repair.

22 Claims, 6 Drawing Sheets

REVERSING RATCHET WRENCH

BACKGROUND OF THE INVENTION

1. Field of the Invention

The present invention relates to hand tools, and more particularly to reversing ratchet wrenches from use with interchangeable socket heads.

2. Description of the Background

Reversing ratchet wrenches are widely used to apply torque for tightening or loosening nuts and bolts. Conventional wrenches include an elongated handle formed with a head at one end for housing the ratchet mechanism. A ratchet driver is rotatably mounted within the housing in engagement with a toothed pawl. The pawl is selectively engagable by operation of a reversing lever into two driver engaging positions in which the driver is limited to one of clockwise or counterclockwise rotation.

The utility of such wrenches largely depends on the design of the reversing ratchet mechanism and the machined head in which it is seated. The design objectives include simplicity and improved manufacturing economy, ease of use, higher strength and durability, conservation of space, protection of internal components, protection of the external reversing lever, and ease of disassembly and repair.

U.S Pat. No. 2,978,081 is one example of a ratchet wrench which conserves space while maintaining durability. However, the machining operations necessary to produce the intricate pawl and driver preclude cost-effective mass production.

U.S. Pat. No. 4,277,990 discloses a wrench of simpler design which is more suitable for mass production. However, this wrench is exceedingly difficult to disassemble for repairs.

U.S. Pat. No. 4,485,700 discloses a wrench design which attempts to minimize both space and cost of manufacture. However, the design incorporates a split ring retainer which hinders disassembly. In addition, both the driver cap and the reversing lever protrude from the wrench head. Consequently, a mechanic cannot easily grip the wrench head to apply pressure while turning. Moreover, the unprotected reversing lever is susceptible to being sheared off and/or inadvertent shifting. The wrench is also prone to clogging by grit and particulates which are drawn between the exposed bearing surfaces.

SUMMARY OF THE INVENTION

It is, therefore, an object of the present invention to provide a reversing ratchet wrench based on a simple design with few easily machinable parts, the design being especially suited for mass production.

It is another object of the invention to provide a more dependable wrench which is also more convenient to use.

It is still another object of the invention to provide a highly impact-resistant wrench which is designed to provide inherent protection for all internal parts from clogging by outside dirt and particulates.

It is another object of the invention to provide a wrench head design which seats the reversing lever in a recessed pocket, thereby protecting the lever against breakage and inadvertent reversing.

It is yet another object of the invention to provide a wrench design which allows convenient disassembly without tools, thereby facilitating point-of-sale repair.

According to the present invention, the above-described and other objects are accomplished by providing an improved reversible ratchet wrench. The wrench comprises a unitary gripping handle and head, the head being formed with a cylindrical driver chamber extending between the upper and lower surface, and a cylindrical pawl chamber extending from the upper surface. The driver chamber is rimmed by a driver skirt at the lower surface, and the pawl chamber is closed at the lower surface by a pawl footing which is unitary with the driver skirt. The two chambers communicate along a peripheral area of overlap. A driver is rotatably seated in the driver chamber. The driver further includes a cylindrical ratchet member defined by teeth arcuately spaced around the periphery, a driver cap covering the upper end of the ratchet member and overlying the driver teeth, an annular shank section, and a drive tang extending from the shank for engagement with various sockets. The wrench also includes a retainer for retaining the driver within the driver chamber, and a pawl rotatably seated within the pawl chamber and having teeth selectably engagable with the driver teeth to permit uni-directional rotation of the driver. The pawl also includes a pawl cap covering the pawl teeth and extending into an annular recess between the driver cap and driver toothed-member. Hence, the pawl cap and overlapping driver cap provide a protective cover for the pawl teeth and driver teeth, and the overlying driver cap serves to retain the pawl within the pawl chamber.

BRIEF DESCRIPTION OF THE DRAWINGS

Other objects, features and advantages of the present invention will become more apparent from the following detailed description of the preferred embodiments and certain modifications thereof when taken together with the accompanying drawings, in which.

DETAILED DESCRIPTION OF THE PREFERRED EMBODIMENT

Figures 1, 2:
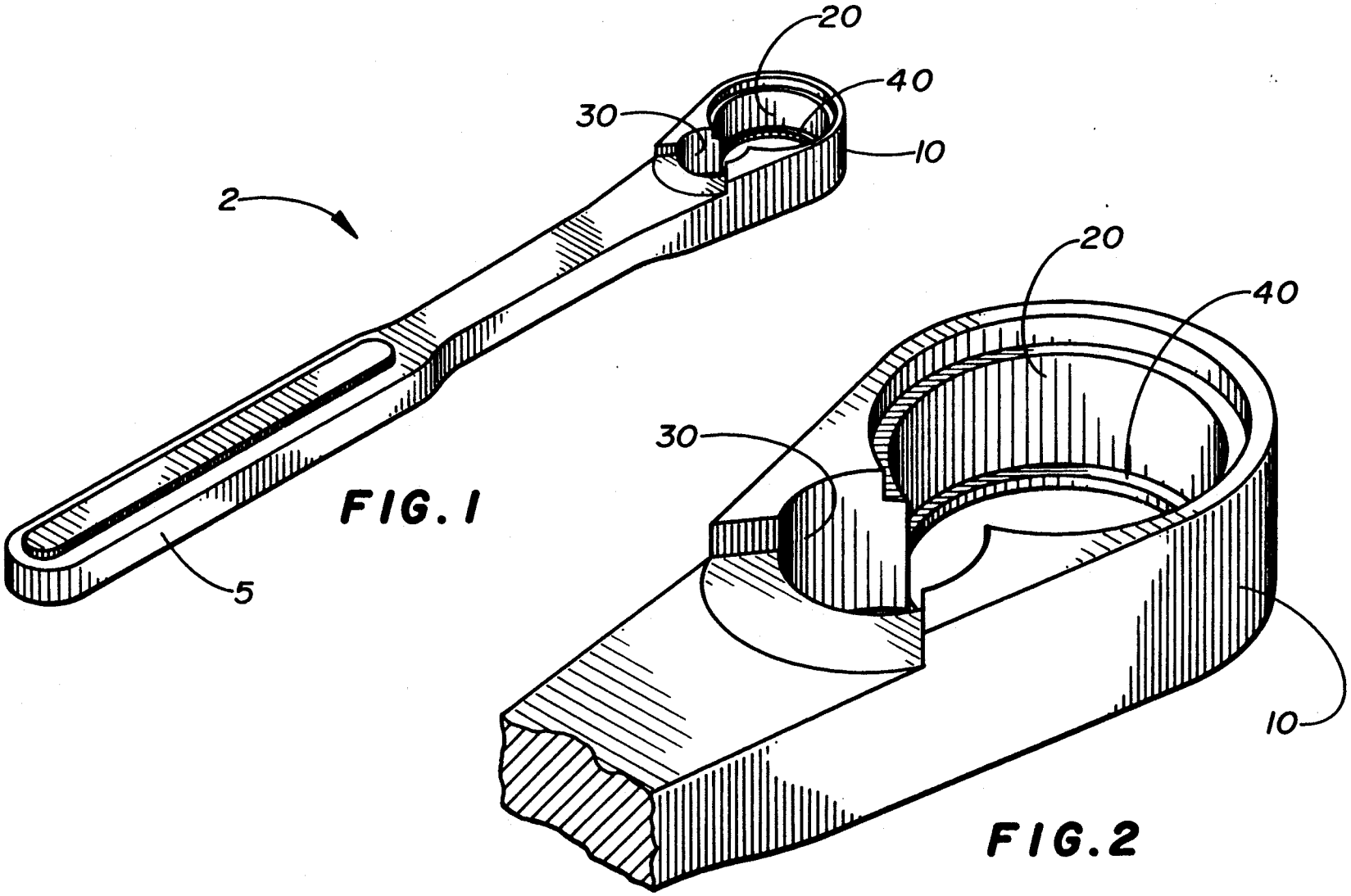
FIG. 1 is a perspective view of a wrench body according to the present invention.
FIG. 2 is an enlarged version of FIG. 1.

FIG. 1 illustrates a perspective view of a wrench body 2 formed in accordance with the present invention. As shown, a wrench body 2 includes an elongated gripping handle 5, and a head 10 which is adapted to house a ratchet assembly.

FIG. 2 is an enlarged view of FIG. 1 which illustrates wrench head 10 more clearly. Head 10 is defined by a generally cylindrical driver chamber 20 and a generally cylindrical pawl chamber 30. Chambers 20 and 30 communicate along an area of overlap. Pawl chamber 30 is substantially closed along the bottom surface of head 10. Driver chamber 20 traverses the upper and lower surfaces of head 10. A peripheral skirt 40, which is formed integrally with head 10, rims the bottom of driver chamber 20.

Figure 3:
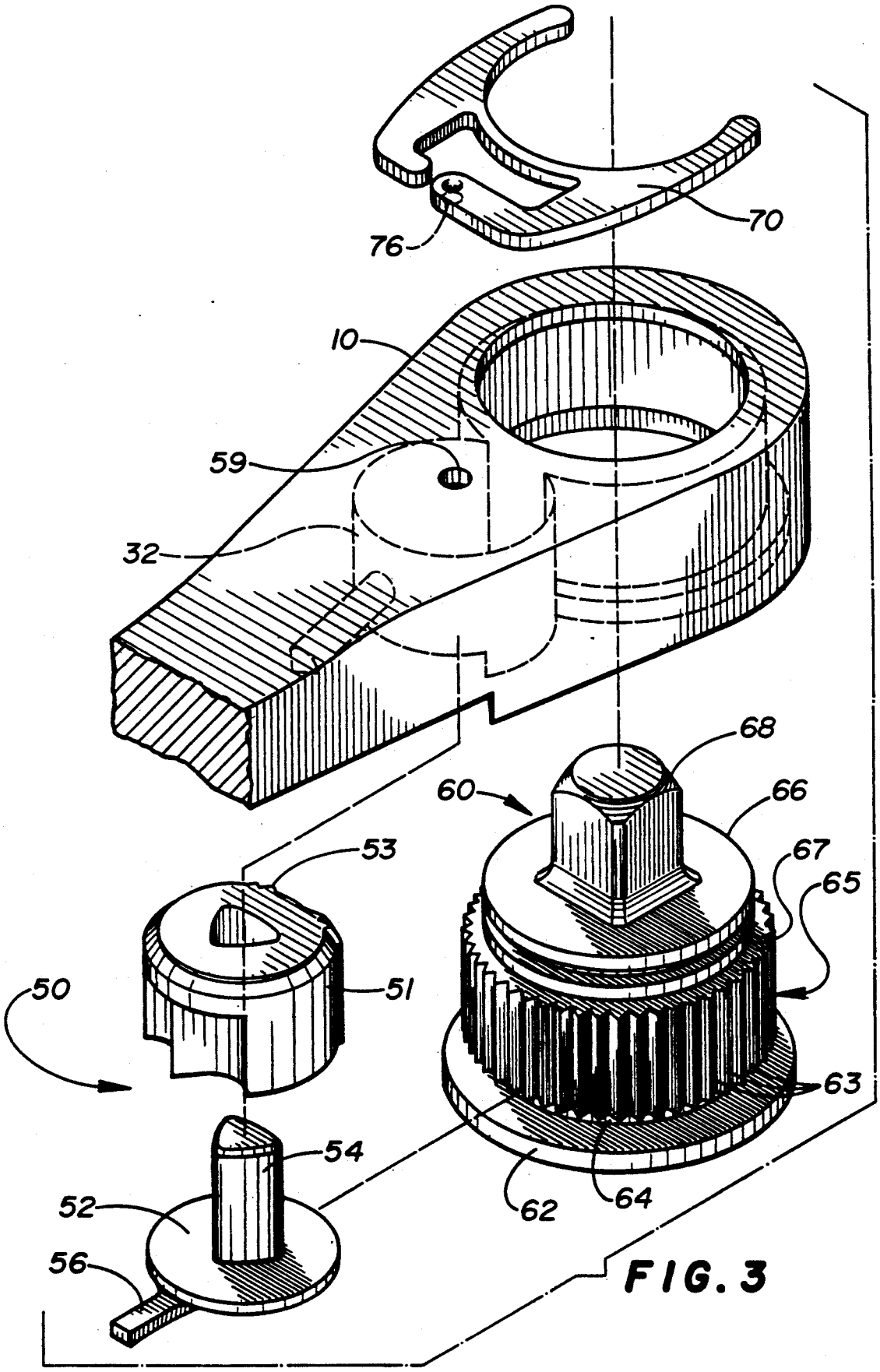
FIG. 3 is an assembly diagram of wrench head 10 equipped with the ratchet mechanism of the present invention.

The above-described features which are formed in head 10 are essential to the improved operation of the wrench. Moreover, they are carefully designed to allow machining with a single machine tool. The reversing mechanism is then assembled into head 10. FIG. 3 is a detailed assembly diagram of wrench head 10 equipped with the ratchet mechanism. A narrow bore 32 extends from the rear of pawl chamber 30 at a downward angle into handle 5. The bore 32, which is not is provided with a spring-mounted detent ball of conventional design (not shown). A pawl 50 includes a generally circular pawl cap 52 and unitary reversing lever 56 with an extending stem 54. Stem 54 fits within a toothed member 51, and is keyed thereto such that toothed member 51 can be rotated by reversing lever 56. The rear of toothed member 51 is defined by a dual recess which engages the spring-mounted detent ball protruding from bore 32 (not shown). The front of toothed member 51 is defined by at least two teeth 53 for engaging the peripheral teeth 63 of a unitary driver 60. Toothed member 51 is adapted to fit within pawl chamber 30, and driver 60 is adapted to fit within driver chamber 20. When toothed member 51 is inserted in pawl chamber 30 and driver 60 is inserted in driver chamber 20, pawl teeth 53 engage driver teeth 63 along the area of chamber overlap. Driver 60 is provided with a driver cover 62 extending over driver teeth 63. The driver cover 62 is spaced from toothed section 65 by an annular groove 64 circling therebetween. Driver 60 is also provided with a cylindrical shank section 66 extending from toothed section 63. A second annular groove 67 encircles shank section 66, and a drive tang 68 protrudes from shank section 66 for engaging sockets and other tools.

To assemble, the spring-mounted detent ball (not shown) is inserted within bore-hole 32. Pawl 50 is then assembled by attaching pawl cap 52 and reversing lever 56 to toothed pawl member 51. Stem 54 provides a interference fit. Pawl 50 is then brought into engagement with driver 60 such that pawl cap 52 extends into groove 64. Pawl 50 and driver 60 are together inserted within respective pawl and driver chambers 30 and 20 until the bottom of toothed member 51 is seated in bearing relation to the substantially closed bottom of pawl chamber 30, and the toothed section 65 of driver 60 is seated in a bearing relation on driver skirt 40. Shank section 66 of driver 60 extends past driver skirt 40, and protrudes outward therefrom.

A retaining clip 70 is then inserted. Retaining clip 70 is provided with a locking C-ring section 72 adapted to fit within annular groove 67 on shank section 66. Retaining clip 70 locks the driver 60 within the driver chamber 20 such that the bottom of toothed section 65 is in bearing engagement with driver skirt 40. A small clearance is maintained on all sides of driver cover 62. This way, driver skirt 40 directly absorbs all downward impacts imparted to driver 60, and upward impacts are transmitted to driver skirt 40 through retaining clip 70. This feature insures superior strength and durability. In addition, this improves the operation of the wrench by limiting the horizontal movement of the driver and eliminating friction which may interfere with the proper engagement of driver 60 and pawl 50.

The above assembly confers an additional advantage in that pawl 50 is secured within pawl chamber 30 by the overlapping driver cover 62. Hence, pawl 50 does not require a separate retainer. Moreover, the pawl cap 52 and overlapping driver cover 62 provide a protective seal against grit and particulates which prevents clogging of pawl teeth 53 and driver teeth 63. The bottom surface of wrench head 10 is similarly sealed by closed pawl chamber 30 and driver skirt 40.

In operation, the spring-mounted detent ball (not shown) biases pawl 50 into one of two drive engaging positions. The drive engaging position is manually selected by operation of reversing lever 56. In a first position, pawl teeth 53 engage driver teeth 63 to allow driver rotation in a clockwise direction, while preventing counter-clockwise rotation. In a second position, rotation occurs in a counter-clockwise direction and is prevented in a clockwise direction.

Figure 4:
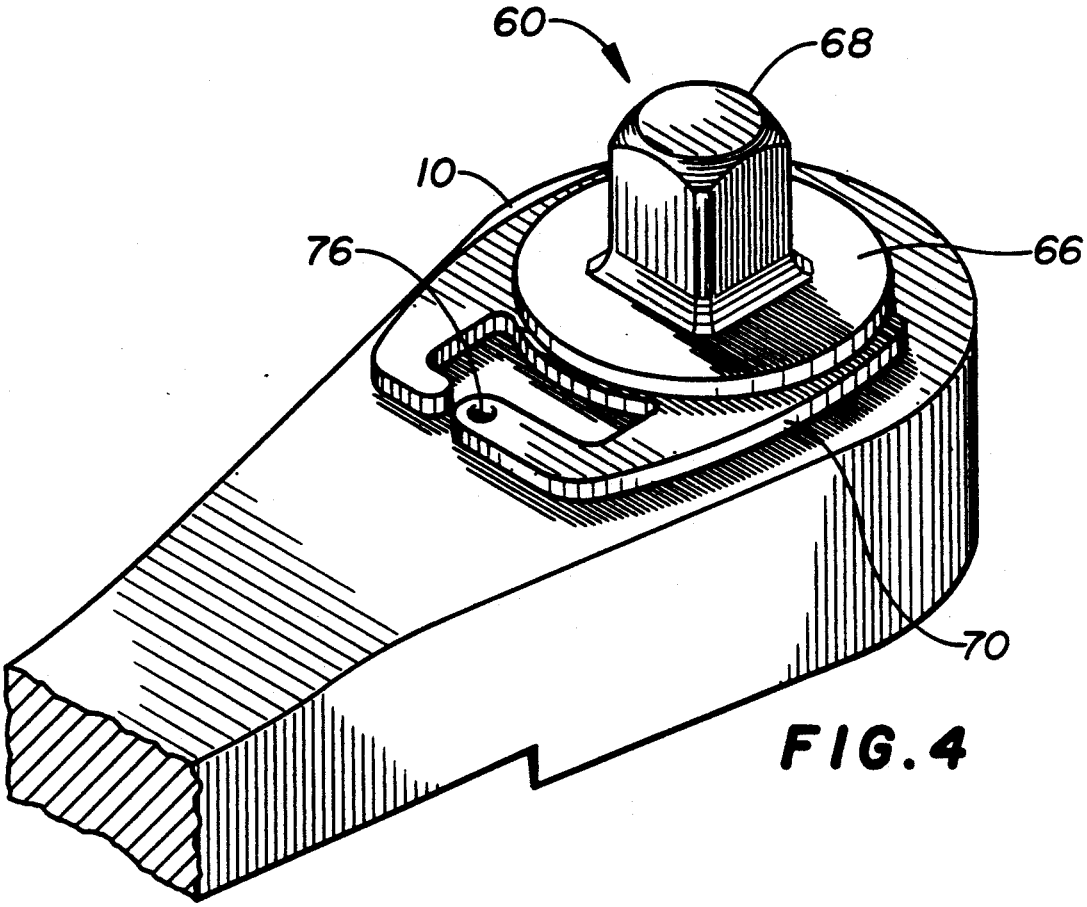
FIGS. 4 and 5 illustrate perspective views of the assembled wrench according to the present invention.
Figure 5:
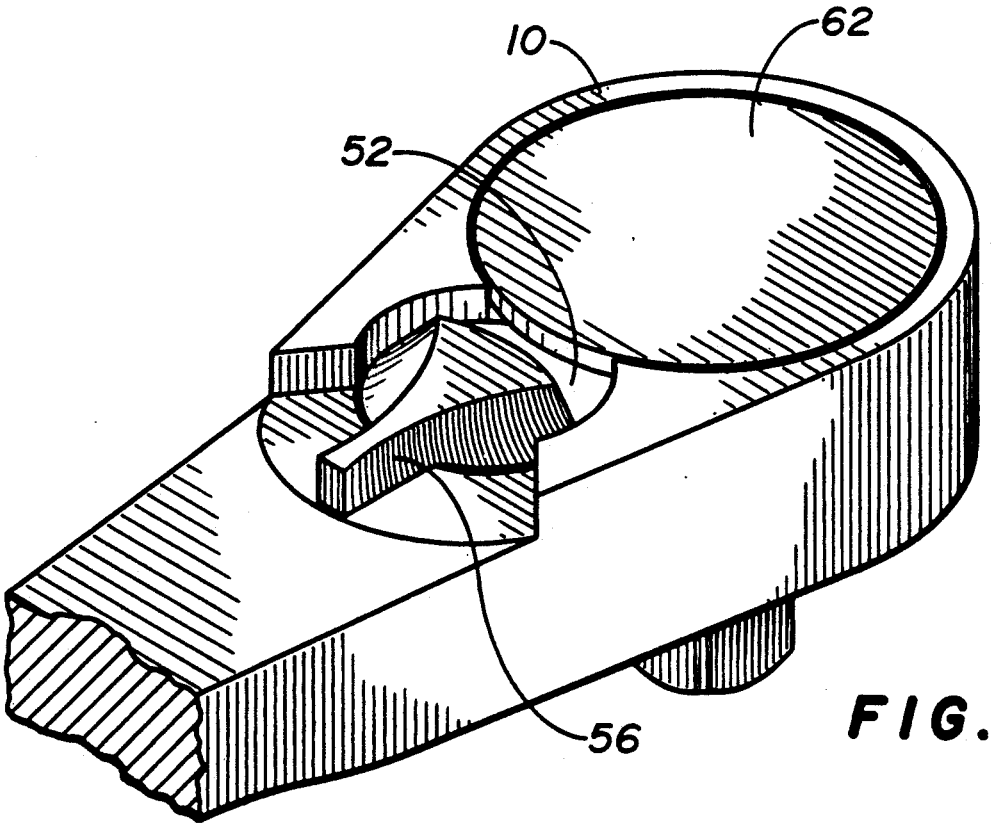

FIGS. 4 and 5 illustrate perspective views of the assembled wrench. As shown in FIG. 4, the shank section 66 and drive tang 68 extend from wrench head 10. Driver 60 is clamped in place by retaining clip 70 which fits within the annular groove 67 in shank section 66. The retaining clip 70 is provided with a small detent button 76 which rests within through-bore 59 in wrench head 10.

FIG. 5 illustrates a top perspective view of the assembled wrench. The upper surface of wrench head 10 is provided with a raised and contoured margin around its periphery. The margin is contoured around the driver cap 62 so that the driver cap sits flush therein. Likewise, the margin is contoured around the sides of pawl cap 52, however, pawl cap 52 is seated beneath driver cap 62 so that the margin rises slightly above pawl cap 52. At the rear of pawl cap 52 the margin terminates, leaving a recessed shelf upon which reversing lever 56 is seated. Pawl cap 52 sits flush with the shelf. The raised and contoured margin provides superior protection for both the driver 60 and pawl 50, and prevents dirt from besieging the teeth. In addition, the reversing lever 56 is well protected within the confines of the recessed shelf formed by the margin, and is less prone to being sheared off or inadvertantly switched.

Figure 6:
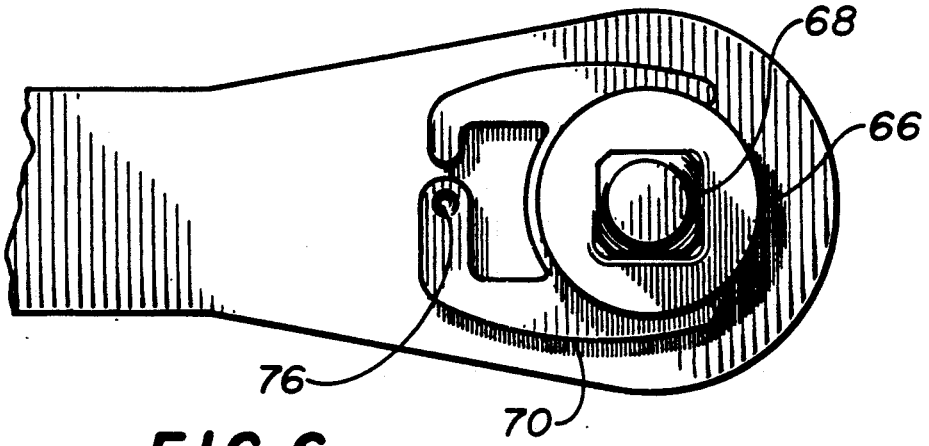
FIGS. 6 and 7 show a bottom view and top view, respectively, of the assembled wrench according to the present invention.
Figure 7:
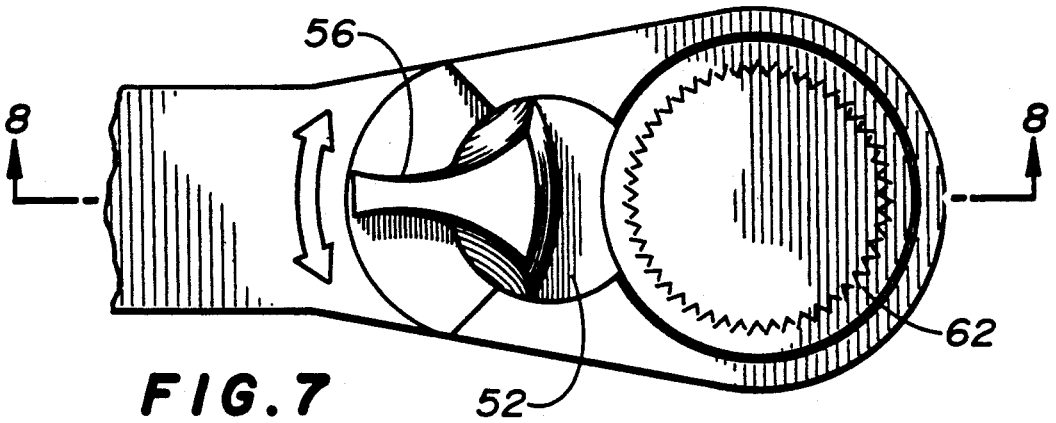

FIGS. 6 and 7 show a bottom view and top view, respectively, of the assembled wrench. The contoured margin around drive cap 62 and pawl cap 52 is clear from FIG. 7. As shown by the arrow, pawl 50 may be switched by reversing lever 56, and reversing lever 56 may be freely maneuvered within the confines of the recessed shelf formed by the margin.

Figure 8:
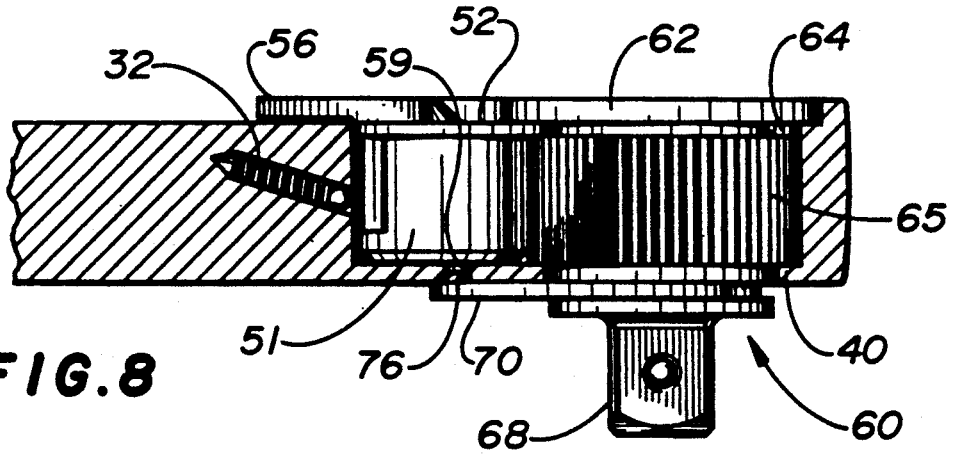
FIG. 8 is a cross-sectional view taken along line A'—A" of FIGS. 6 and 7.

FIG. 8 is a cross-sectional view taken along line A'—A" of FIGS. 6 and 7. As shown, toothed member 51 is rotatably seated within pawl chamber 30 in bearing relation to the substantially closed end. Likewise, driver 60 is rotatably seated within driver chamber 20 in bearing relation to driver skirt 40. Pawl teeth 53 are in direct engagement with driver teeth 63. A small clearance is maintained on all sides of driver cap 62. Thus, all axial forces imparted to driver 60 are transmitted to the driver skirt 40 which is unitary with the wrench head. The driver cap 62 is flush with the margin on wrench head 10. Although the driver cap 62 rotates with the driver 60, a mechanic may freely grip the wrench head 10 without being affected by the rotation.

Pawl cap 52 extends beneath driver cover 62 and into the annular recess 64 separating the driver cap 62 from toothed section 65. Pawl 50 is sandwiched between driver cap 62 and the bottom of pawl chamber 30. Hence, a separate retainer is unnecessary.

Figure 9:
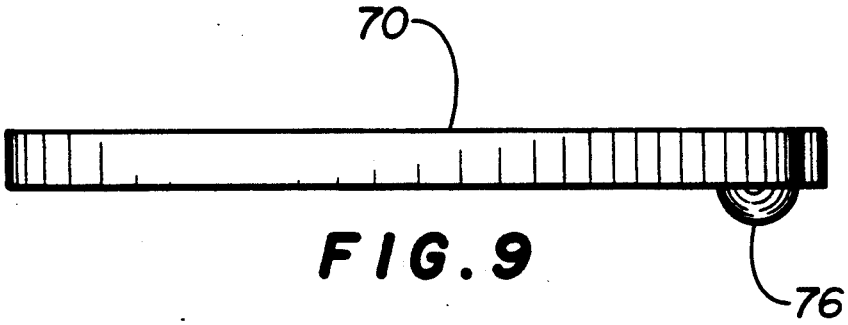
FIGS. 9 and 10 illustrate a side view and top view, respectively, of the retaining clip 70.
Figure 10:
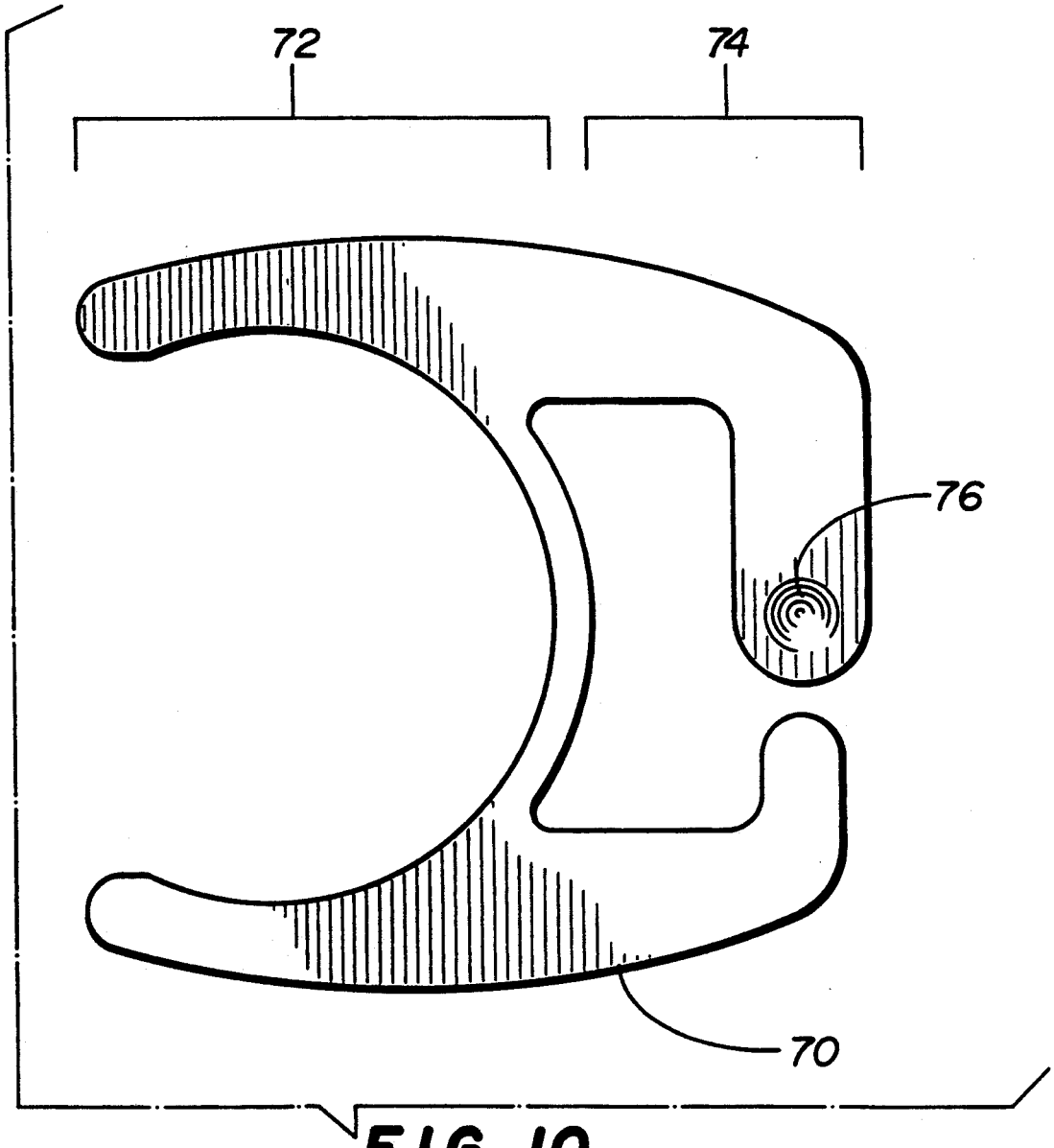

FIGS. 9 and 10 illustrate the retaining clip 70, which comprises a locking C-ring section 72 and a finger tab section 74 with detent button 76. Locking C-ring section 72 further includes opposing resilient fingers adapted to fit within and provide locking engagement with recess 67 and shank section 66 of driver 60. Finger tab section 74 of retaining clip 70 comprises two rearwardly extending tabs designed to provide a finger grip. Detent button 76 is adapted to fit within through-bore 59 of wrench head 10.

Figure 11:
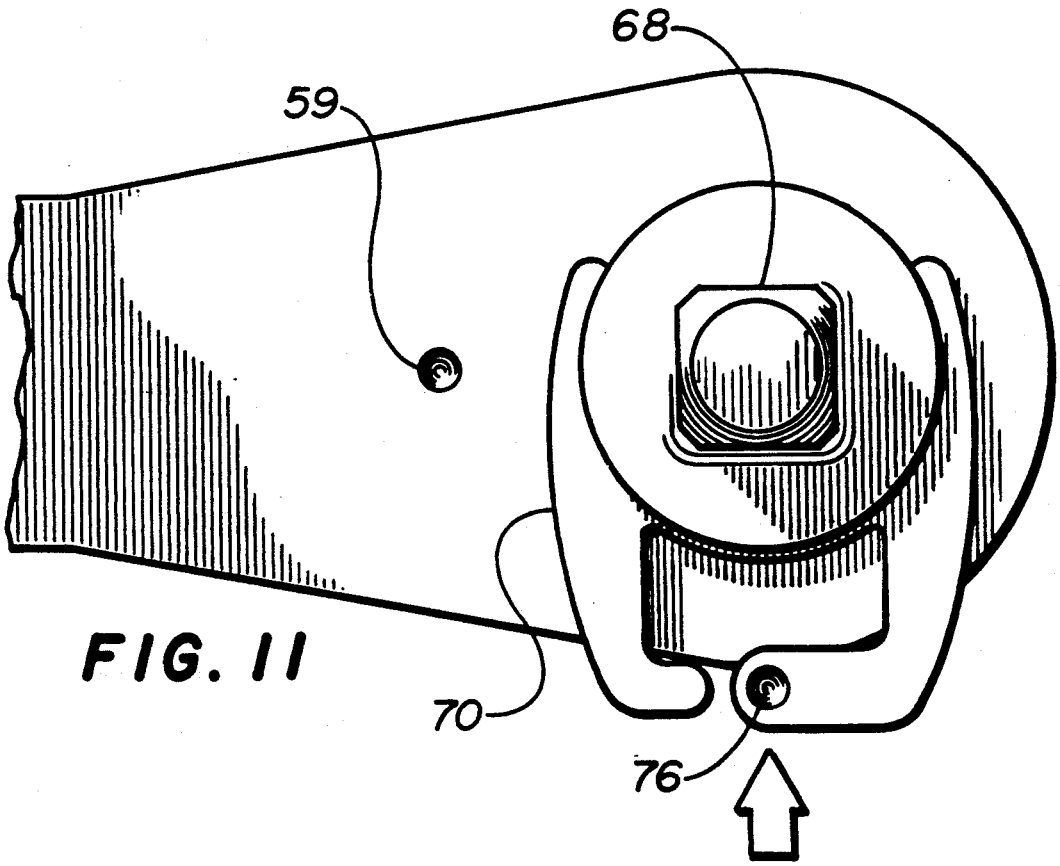
FIGS. 11 and 12 show the manner of insertion of retaining clip 70 according to the present invention.
Figure 12:
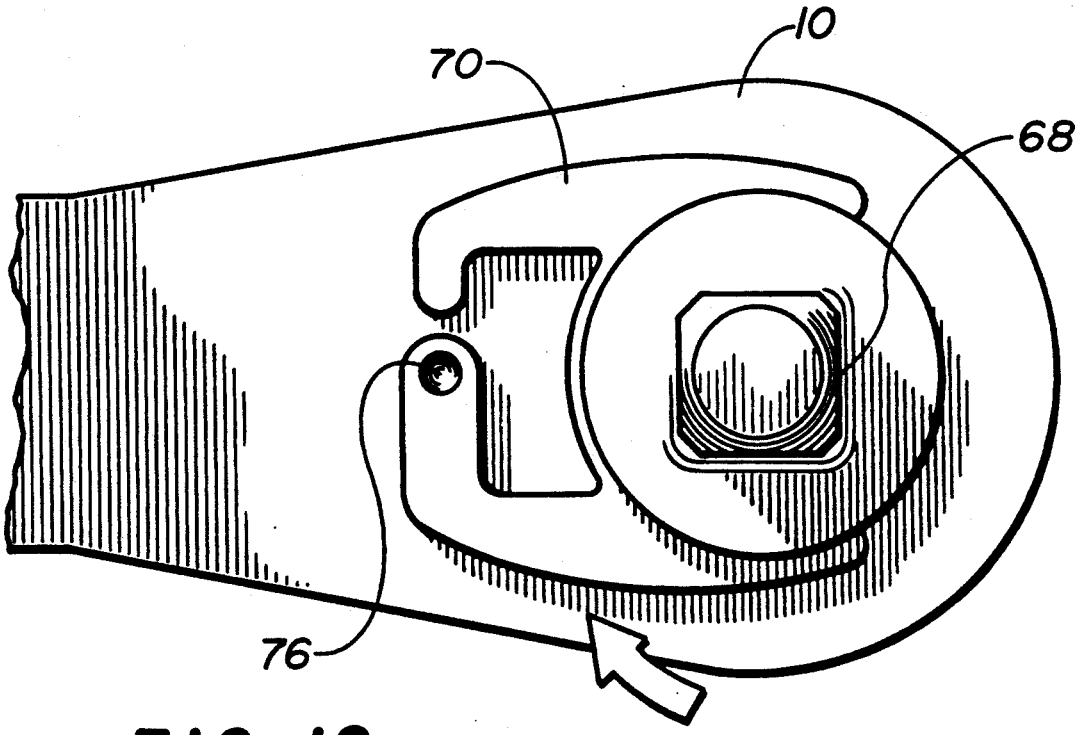

FIGS. 11 and 12 show the manner of insertion of retaining clip 70. As shown in FIG. 8, retaining clip 70 is preferably inserted transversely onto the shank section 66 of driver 60. Since retaining clip 70 protrudes outward from wrench head 10, the entire operation can be accomplished by hand without the special tools typically required for disassembly of conventional wrenches. Reversing lever 70 is then rotated around shank section 66 until detent button 76 becomes engaged in through-bore 59. At this position the retaining clip 70 is axially aligned with the handle of the wrench, and is completely non-intrusive.

At this point the wrench is fully assembled and is completely operational. A primary advantage of the above-described construction lies in the convenient assembly and disassembly of the wrench. Disassembly entails disengaging detent button 76 from through-bore 59, rotating retaining clip 70 until finger tab section 74 extends from the wrench head 10, and pulling retaining clip 70 from the shank section 66 of driver 60. At this point, pawl cover 52 can be conveniently replaced without the need to remove the toothed member 51 from pawl chamber 30. If need be, both driver 60 and pawl 50 may be conveniently removed from within respective pawl and driver chambers 20 and 30. The entire assembly and disassembly operation can be effected manually in minutes. Hence, the wrench is highly serviceable, and repairs may take place at the point of sale rather than a special repair depot.

Having now fully set forth the preferred embodiments and certain modifications of the concept underlying the present invention, various other embodiments as well as certain variations and modifications of the embodiment herein shown and described will obviously occur to those skilled in the art upon becoming familiar with said underlying concept. It is to be understood, therefore, that within the scope of the appended claims, the invention may be practiced otherwise than as specifically set forth herein.

What is claimed is:

1. A reversible ratchet wrench, comprising:

a gripping handle;

a wrench head formed with a first surface, an opposing second surface, a substantially cylindrical driver chamber extending inwardly from said first surface, and a substantially cylindrical pawl chamber adjacent to said driver chamber and extending inwardly from said first surface, said driver chamber communicating with said pawl chamber along a peripheral area of overlap;

a driver rotatably seated in said driver chamber, said driver further comprising, a generally cylindrical pawl-engaging member defined by driver teeth arcuately spaced around the periphery, a driver cap overlying one end of said pawl-engaging member and covering said driver teeth, the junction between said driver cap and said pawl-engaging member being defined by an annular groove therebetween, and a drive tang at another end of said pawl-engaging member;

a retainer for retaining said driver within said driver chamber;

a pawl rotatably seated within said pawl chamber, said pawl having outwardly facing pawl teeth selectably engagable with said driver teeth to permit uni-directional rotation of said driver, said pawl also including a pawl cap covering said pawl teeth and projecting into said annular groove between said driver cap and said pawl-engaging member of said driver, said pawl cap and overlapping driver cap providing a protective cover for said pawl teeth and driver teeth over the respective chambers, and said pawl being retained within said pawl chamber by the driver cap overlying said pawl cap.

2. The reversible ratchet wrench according to claim 1, wherein said pawl may be removed from said pawl chamber after raising the driver from within the driver chamber.

3. A reversible ratchet wrench, comprising:

a gripping handle;

a wrench head formed with a first surface, an opposing second surface, and a driver chamber extending inwardly from said first surface, and a driver skirt contiguous with said second surface of said wrench head and providing an annular shelf within said driver chamber;

a driver rotatably seated on said driver skirt and within said driver chamber, said driver further comprising, a substantially cylindrical pawl-engaging member defined by teeth arcuately spaced around the periphery, said pawl engaging member being rotatably seated on said driver skirt, a shank section extending from said pawl-engaging member through said driver skirt and outside said driver chamber, said shank having an annular groove flush with said second surface of said wrench head, and a drive tang extending from said shank;

a pawl having teeth selectably engagable with said driver teeth to permit uni-directional rotation of said driver;

a retaining clip for retaining said driver within said driver chamber, said retaining clip further comprising a C-coupling for releasible engagement with the annular groove of said shank, and a unitary finger-tab for allowing hand insertion and removal of said retaining clip.

4. The wrench according to claim 3, wherein said C-coupling of said retaining clip further comprises opposing resilient fingers for partially encircling the annular groove of said shank.

5. The wrench according to claim 4, wherein said finger-tab is co-planar with said fingers and extends oppositely therefrom, said finger-tab protruding from said wrench head when in a first position to provide access, and said finger-tab being maneuverable to rotate said C-coupling around said shank to a second position in which said finger-tab is does not protrude from said wrench head.

6. The wrench according to claim 5, wherein said wrench head is defined by a bore-hole on said second surface, and said finger tab is provided with a detent button adapted to fit within said bore-hole for releasibly locking said retaining clip in said second position.

7. A retaining clip for retaining a rotatable driver within a driver chamber of a tool head, said retaining clip comprising:

a C-coupling for pivotally retaining said rotatable driver within said driver chamber of said tool head, said C-coupling having opposing resilient fingers for partially embracing said rotatable driver to thereby form a flange over said driver chamber; and a unitary finger-tab for allowing hand insertion of said retaining clip on said driver, said finger-tab being co-planar with said C-coupling and extending oppositely therefrom, and said finger-tab further comprising a detent button projecting upwardly toward said tool head;

whereby said finger-tab protrudes from said tool when in a first position to allow hand access, and said finger-tab may be pivoted to a second non-protruding position and releasibly locked in said second position by engagement of said detent button in a corresponding alignment cavity in said tool head.

8. A reversible ratchet wrench, comprising:

a gripping handle;

a wrench head defined by a first and second surface, said head being formed with a driver chamber extending therethrough between said first and second surfaces and having a smaller radius at the second surface to render a unitary driver skirt, and said head also being formed with a pawl chamber extending from said first surface to a pawl footing unitary with said driver skirt, said driver chamber communicating with said pawl chamber along a peripheral area of overlap;

a driver rotatably seated in said driver chamber, said driver further comprising, a cylindrical pawl-engaging section defined by teeth arcuately spaced around the periphery, said pawl-engaging section being seated in bearing contact on said driver skirt, a driver cap overlying said pawl-engaging section and covering said driver teeth, a shank section extending past and receiving transverse support from said driver skirt, and a drive tang extending from said shank section;

a retainer for retaining said driver within said driving chamber;

a pawl rotatably seated within said pawl chamber, said pawl including pawl teeth selectably engagable with sad driver teeth to permit uni-directional rotation of said driver, said pawl also including a pawl cap covering said pawl teeth, said pawl cap and driver cap providing a protective cover for said pawl teeth and driver teeth.

9. The reversible ratchet wrench according to claim 8, wherein a small clearance is preserved between said driver cap and said wrench head, the driver being rotatably seated in said driver chamber and fully supported by said driver skirt and retainer for transmitting force solely thereto.

10. The reversible ratchet wrench according to claim 9, wherein said driver chamber is formed with a larger diameter aperture at the first surface, and said driver cap is recessed in said aperture flush with said first surface.

11. The reversible ratchet wrench according to claim 9, wherein said wrench head is provided with an upward-protruding margin around the periphery of the first surface and bordering said driver cap, said driver cap being flush with said margin to give a flush appearance with said wrench head.

12. The reversible ratchet wrench according to claim 9, whereby said driver is formed with an annular groove occurring between said pawl-engaging section and driver cap, and said pawl includes a pawl cap covering said pawl teeth and projecting into said annular groove between said driver cap and pawl-engaging section of said driver, said pawl cap and overlying driver cap providing a protective cover for the pawl and driver teeth, and said pawl being retained within said pawl chamber by the overlying driver cap.

13. The reversible ratchet wrench according to claim 10, whereby said driver is formed with an annular groove occurring between said pawl-engaging section and driver cap, and said pawl includes a pawl cap covering said pawl teeth and projecting into said annular groove between said driver cap and pawl-engaging section of said driver, said pawl cap and overlying driver cap providing a protective cover for the teeth of said pawl and driver, and said pawl being retained within said pawl chamber by the overlying driver cap.

14. The reversible ratchet wrench according to claim 11, whereby said driver is formed with an annular groove occurring between said pawl-engaging section and driver cap, and said pawl includes a pawl cap covering said pawl teeth and projecting into said annular groove between said driver cap and pawl-engaging section of said driver, said pawl cap and overlying driver cap providing a protective cover for the teeth of said pawl and driver, and said pawl being retained within said pawl chamber by the overlying driver cap.

15. The reversible ratchet wrench according to claim 13, whereby said retainer comprises a retaining clip for retaining said driver within said driver chamber, said retaining clip including a C-coupling for releasable engagement with an annular groove encircling said shank section, and a unitary finger-tab for allowing hand insertion and removal of said retaining clip.

16. The wrench according to claim 15, wherein said C-coupling of said retaining clip further comprises opposing resilient fingers for partially encircling the annular groove of said shank section.

17. The wrench according to claim 16, wherein said finger-tab is co-planar with said fingers and extends oppositely therefrom, said finger-tab protruding from said wrench head when in a first position to provide access, and said finger-tab being maneuverable to rotate said C-coupling around said shank section to a second position in which said finger-tab is does not protrude from said wrench head.

18. The wrench according to claim 17, wherein said wrench head is defined by a bore-hole on said second surface, and said retaining clip is provided with a detent button positioned along said finger-tab for releasibly locking said finger-tab in said second position.

19. The reversible ratchet wrench according to claim 14, whereby said retainer comprises a retaining clip for retaining said driver within said driver chamber, said retaining clip including a C-coupling for releasable engagement an the annular groove on said shank section, and a unitary finger-tab for allowing hand insertion and removal of said retaining clip.

20. The wrench according to claim 19, wherein said C-coupling of said retaining clip further comprises opposing resilient fingers for partially encircling the annular groove of said shank section.

21. The wrench according to claim 20, wherein said finger-tab is co-planar with said fingers and extends oppositely therefrom, said finger-tab protruding from said wrench head when in a first position to provide access, and said finger-tab being maneuverable to rotate said C-coupling around said shank section to a second position in which said finger-tab is aligned with and does not protrude from said wrench head.

22. The wrench according to claim 21, wherein said wrench head is defined by a bore-hole on said second surface, and said retaining clip is provided with a detent button positioned on said finger-tab for releasibly locking said finger-tab in said second position.

* * * * *